United States Patent [19]

Femino et al.

[11] Patent Number: 4,652,726

[45] Date of Patent: Mar. 24, 1987

[54] WATERBED MATTRESS HEATER

[76] Inventors: John A. Femino; Wilbur E. Mitchener; Roy D. Moss; Albert Stevens, all of 2630 Seaman Ave., El Monte, Calif. 91733

[21] Appl. No.: 817,973

[22] Filed: Jan. 13, 1986

[51] Int. Cl.[4] ..... H05B 1/02

[52] U.S. Cl. ..... 219/217; 5/424; 5/451; 219/518

[58] Field of Search ..... 219/217, 518; 200/85 R, 200/DIG. 18; 5/508, 424, 451

[56] References Cited

U.S. PATENT DOCUMENTS

| | | | |
|---|---|---|---|
| 4,066,072 | 1/1978 | Cummins | 5/424 |
| 4,067,005 | 1/1978 | Levy | 5/424 |
| 4,263,586 | 4/1981 | Nicholas | 200/85 R |

*Primary Examiner*—E. A. Goldberg
*Assistant Examiner*—Teresa J. Walberg
*Attorney, Agent, or Firm*—Georges A. Maxwell

[57] ABSTRACT

A normally flat horizontal blanket-type waterbed heater unit having top and bottom laminates of thin flexible dielectric sheet plastic material and an elongate electric resistance element arranged and sealingly engaged between the laminates. A power supply cord connects with opposite ends of the element and extends from the unit. The unit further includes a normally open safety switch connected with and between related ends of sections of the element. The switch includes spaced terminals atop the bottom laminate, a contact bar above the terminals and below the top laminate and a resilient insulating support part between the laminates and adjacent the terminals and bar. The part normally yieldingly holds the bar and adjacent portion of the top laminate spaced above the terminals. The unit is arranged atop a water bed mattress supporting platform and below the bottom wall of a sheet plastic waterbed mattress bladder. The safety switch is such that when the depth of the water in the mattress is above a minimum safe depth, the weight of the water acting on the switch closes the switch. When the depth of the water in the mattress is below a safe minimum depth, the support part of the switch moves the bottom wall, adjacent portion of the top laminate and the bar vertically relative to and out of contact with the terminals.

11 Claims, 15 Drawing Figures

WATERBED MATTRESS HEATER

This invention has to do with waterbed heaters and is particularly concerned with an improved blanket-type electric resistance heater for waterbeds with a fluid pressure actuated safety switch.

BACKGROUND OF THE INVENTION

In the art, waterbeds are comprised of water-filled bladder-type mattresses supported at their bottoms and about their sides by horizontal decks and vertical side and end walls of related bed frame structures. It has long been common practice to heat the water within the mattresses to temperatures which are most comfortable for the users of the beds. The water in waterbed mattresses is commonly heated by electric resistance heater units positioned between the bottoms of the mattresses and the decks of their related frame structures. The heater units are supplied with electric current through electric service cords which extend from the heaters and the bed structures to common electric power service outlets in the rooms or buildings in which the beds are used.

In the case of most waterbed heater units, manually adjustable temperature control devices are engaged in the service cords. The control units include thermostatic switches controlling the flow of current in the heater units and include temperature sensing devices, such as thermocouples, which are arranged to contact the mattresses at locations remote from the heater units so that the thermostatic switches operate in response to the mean temperature of the water in the mattresses, not the temperature of the water imediately adjacent or close to the heater units.

Ordinary waterbed mattresses are from 84 inches long, 48 inches to 72 inches wide, and from 7 inches to 8 inches in depth or vertical extent. Accordingly, the volume of water in such mattresses is substantial and establish excellent heat sinks which absorb heat generated by related heater units and which disperses that heat throughout the mattresses at a rate which is sufficiently close to the rate at which heat is generated by the heater units. The rate at which the heat is dispersed throughout such mattresses is such that an accumulation of heat and overheating of the bed structures adjacent the heater units will not occur during normal and intended use of the waterbed structures. More particularly, the normal volume of water in waterbed mattresses absorbs and disperses the heat generated by related heater units at a rate which is sufficient to keep the temperature of the commonly used polyvinylchloride sheet stock of the mattresses which is in contact with the heater units cool and well below those temperatures at which the plastic material commences to degradate and/or burn.

While the foregoing results in or provides suitably heated waterbed structures that are safe to operate and use under ordinary and intended operating conditions, the heater units, with and without related temperature control means, are capable of and/or subject to rapidly overheating causing other irreparable damage and injury if and when the volume of water in the mattresses is reduced to an extent that it affords a heat sink which is insufficient and/or inadequate to absorb and disperse heat generated by the heater units at a sufficient rate to prevent accumulation of heat at and about the heater unit; and when the volume of water is reduced to an extent that the weight of persons or other objects positioned atop and supported by the mattresses displace the water above the heater units and allows the tops of the mattresses to "bottom out" or establish bearing contact on the bottoms of the mattresses. When the foregoing occurs, the capacity of the water remaining in the mattresses to maintain the temperature of the sheet plastic of the mattresses and the heater units at safe, non-excessive temperatures is lost. It is also to be noted that due to the necessary displacement or remote positioning of the heat sensing devices of the temperature control units for the heater units, those temperature control units are of little use or value to prevent the adverse effects and damage which is likely to be caused by the heater units when the normal volume of water in the mattresses is reduced or diminished to an extent that adverse effects are likely to result.

As a result of the foregoing laws have been instituted which require the manufacturers of waterbeds and waterbed heaters to boldly display special warnings and instructions to the purchasers and users of waterbeds directing them not to plug in and or connect waterbed heater units with power supplies until the mattresses are filled with water and to unplug or disconnect the heater units from their power supplies before draining of water therefrom is commenced.

While the above warnings and instructions might be expected to be adequate to prevent heat damage of the nature and character noted above, when some purchasers and users of waterbeds and waterbed heaters fill and drain their waterbeds, history and experience indicates that those warnings and instructions are often not understood or are ignored and/or injuries result.

Further and more important, the warnings and instructions noted above are only effective when waterbeds are being filled, emptied or otherwise visually monitored and worked upon. Such warnings and instructions are of no use or value when waterbed mattresses rupture or spring leaks when unattended or when they are in use or occupied by persons who are asleep or incapable of suitably responding to dangerous conditions due to some physical incapacity.

Experience and history indicate that the number of incidents in which overheating of waterbed heater units cause adverse effects and damage to waterbed structures in the course of filling and emptying the mattresses, is in fact negligible compared to the number of incidents in which damage to property and personal injuries occurs as a result of overheating of heater units and their related bed structures caused by the loss or leakage of water from mattresses, when waterbeds are unattended and when they are in use (when written warnings and instructions serve no useful purpose).

To the best of our knowledge and belief, the prior art has long recognized the extreme hazards associated with the loss of water in waterbed mattresses with which heater units are related, but has failed to provided any reasonably effective and commercially practical means to eliminate those hazards.

It is our understanding that the prior has provided at least one independent alarm system to warm of the leakage of water from within the mattresses of waterbed structures and to thereby reduce the hazards caused by such leakage. That alarm system included a water actuated triggering switch arranged in a related waterbed structure beneath the mattress thereof. The switch was closed by water leaked from the mattress and which flowed or migrated into contact therewith. The principal shortcoming of the above noted alarm system resided in the fact that it was subject to being actuated by any liquid (other than water from within the mattress) which might be spilled, condensed or otherwise collect and find its way into the waterbed structure where the switch occured and proved to be highly susceptible to giving false alarms. Further, that alarm system, being an independent or separate system, was sold separately, required independent handling and installation and was considered by the majority of installers and users of waterbeds to be inconvenient and bothersome.

OBJECTS AND FEATURES OF OUR INVENTION

It is an object of our invention to provide a waterbed structure comprising a water-filled mattress of flexible sheet plastic material supported atop the deck of a waterbed frame, an electric resistance heater unit positioned between the mattress and the deck to heat the water within the mattress and a pressure actuated safety switch controlling the flow of current through the heater unit and positioned between the deck and the mattress.

It is an object and feature of our invention to provide a waterbed structure of the general character referred to above wherein the pressure actuated switch between the deck and the mattress is a normally open switch and is actuated or closed by the weight of the mattress, that is, the hydrostatic head pressure of the water within the mattress above it.

Yet another object and feature of our invention is to provide a waterbed structure of the general character referred to above wherein the safety switch is maintained in closed or actuated position when the depth of water in the mattress and the resulting hydrostatic head pressure of that water acting upon the switch is greater than a minimum safe depth of water and wherein the safety switch opens or is unactuated when the depth of water in the mattress and the resulting hydrostatic head pressure of the water above and acting upon the switch is less than a minimum safe depth of water to prevent sustained bottoming out between the top and bottom of the mattress and/or to absorb and disperse heat generated by the heater unit away from the heater unit at a rate sufficient to prevent the accumulation of excess heat in the bed structure at and adjacent said heater unit.

Still another object and feature of our invention is to provide a waterbed structure of the general character referred to above wherein said safety switch is incorporated in its related resistance heater unit as an integral part thereof and requires no special external wiring or connections and which is such that its function to protect against overheating of its adjacent and related parts and portions of the bed structure is assured at all times, thus eliminating the requirement of special warnings, installation instruction and/or special manipulation and handling of the heater unit and other related parts of the bed structure.

The foregoing and other objects and features of our invention will be apparent and fully understood from the following detailed description of typical preferred forms and embodiments of our invention, throughout which description refernce is made to the accompanying drawings.

DETAILED DESCRIPTION OF THE INVENTION

Figure 1:
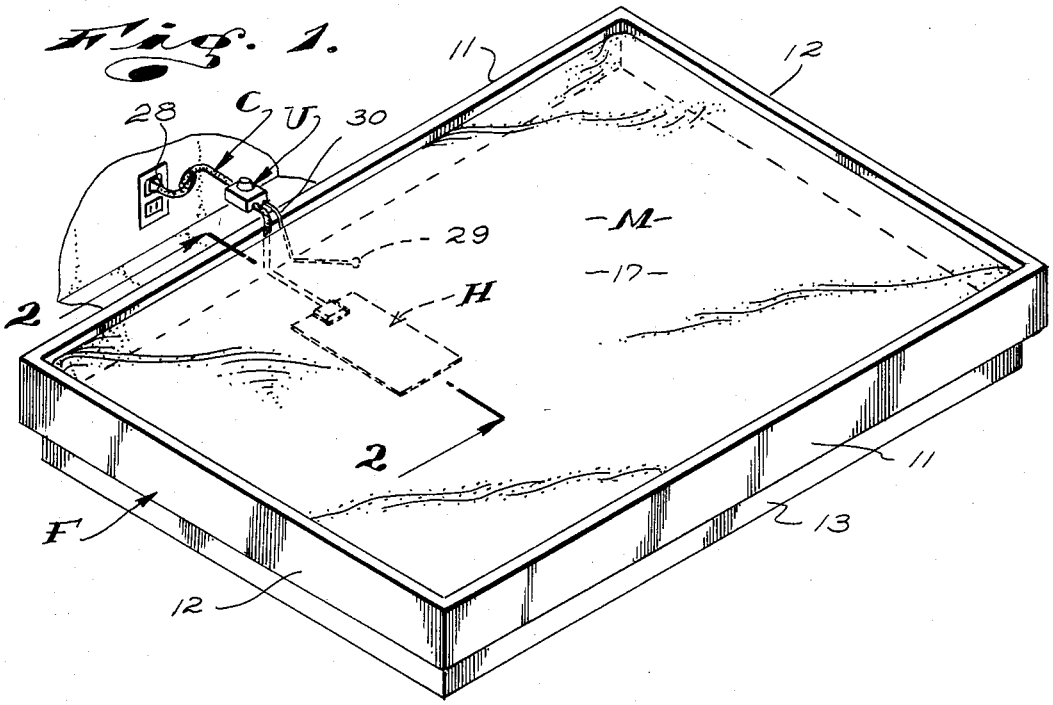
FIG. 1 is an isometric view of a waterbed structure embodying our invention.
Figure 2:
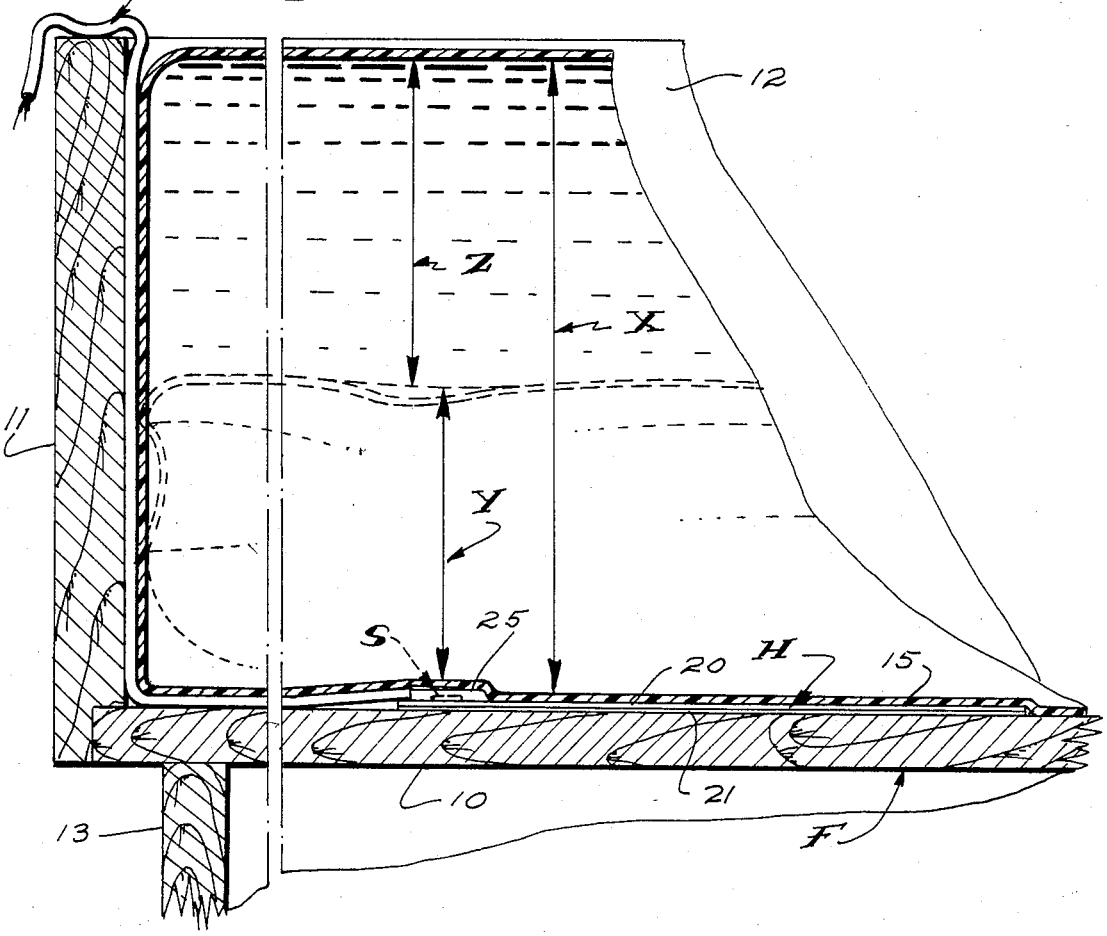
FIG. 2 is an enlarged detailed sectional view of a portion of the structure shown in FIG. 1 and taken substantially as indicated by line 2—2 on FIG. 1.

In FIGS. 1 and 2 of the drawings, we have illustrated a typical waterbed structure embodying our invention. The bed structure is characterized by and/or includes a frame F, a mattress M and an electric resistance heater H.

The frame F, in accordance with common practice, can be made of wood and includes a flat, rectangular, upwardly disposed horizontal mattress supporting deck 10, vertical side and end walls 11 and 12 about the perimeter of and projecting upwardly from the deck and, in the case illustrated, a pedestal 13 supporting the deck in desired vertical spaced relationship above a related floor 14.

The mattress M is a substantially rectilinear envelope or bladder formed of supple and flexible sheet plastic, such as polyvinylchloride plastic. The mattress is formed so that when substantially fully extended or inflated with water, it conforms to the upwardly opening interior confines of the frame F defined by the deck and walls thereof. The mattress, when inflated, or full, defines a flat, horizontal bottom wall 15 in substantial flat uniform supported engagement with the deck 10, vertical side walls 16 in supported engagement with the inside surfaces of the side and end walls 11 and 12 of the frame and a normally substantially flat, horizontal body supporting top wall 17 which normally lies in a plane slightly below the horizontal plane of the open top of the frame F, defined by the upper edges of the walls 11 and 12 thereof.

In addition to the above, the mattress M is provided with a normally closed water conducting fitting (not shown) to facilitate filling and emptying the mattress with a volume of water and, if necessary or desired, to drain water from the mattress. The water conducting fitting can vary widely in form and construction and is suitably located where it is readily accessible.

Since the noted water conducting fitting is a standard and common part of waterbed mattresses well-known to all of those who are skilled in the art and since it in no way affects the novelty and spirit of our invention, illustration and further detailed description thereof can and will be dispensed with.

In practice, the sheet plastic of which the mattress is made is from 0.020 inches to 0.022 inches thick and is suitably cut, formed and thermally welded to establish the mattress in its desired and intended size and shape.

The mattress M used in carrying out our invention can be substantially any standard make, model and/or brand of commercially available waterbed mattress.

For the purpose of this disclosure, the full depth or normal vertical distance between the top and bottom walls 15 and 17 of the mattress M, indicated by the arrow X in FIG. 2 of the drawings, is between 6 inches and 8 inches and the normal hydrostatic head pressure established by the volume of water therein is between about 0.224 psi and 0.298 psi.

In addition to the above, it is to be noted that in practice, waterbed mattresses of the general character here concerned with are subject to rupturing and/or springing leaks with resulting loss of water and the lowering of the depth of the water and the corresponding hydrostatic head pressure established thereby.

Further, in waterbeds of the general character noted above and here concerned with, the minimum functional depth or vertical distance between the top and bottom walls 17 and 15 is that depth or distance which allows the top wall 17 to be depressed thrust into sustained stopped and bearing engagement with the bottom wall 15 by the weight of a person sitting or lying upon the top wall 17 thereof. While the minimum depth depends upon the weight of the person using the bed and is therefore subject to substantial variation, it is normally between 4 and 6 inches. A depth of 4 inches or less, as generally indicated by the arrow Y in FIG. 2 of the drawings, with rare exception, renders of the bed unusable for its intended purpose.

When, for example, the depth of the water drops to 4 inches, the hydrostatic head pressure lowers to about 0.149 psi and when at but 3 inches, the pressure is 0.112 psi.

In the examples given above, assuming the full depth of the mattress is 8 inches and the loss of water lowers the depth 5 inches, as indicated by arrow Z in FIG. 2 of the drawings, the lowering of the heat pressure is from 0.299 psi to 0.187 psi with a differential of 0.112 psi. The heater unit H that we have elected to use in carrying out our invention is a thin, flat, rectilinear blanket-type electric resistance heater, including top and bottom laminates 20 and 21 of thin, flexible, dimensionally stable dielectric plastic sheet stock such as that plastic sheet stock produced and sold by DuPont under the tradename Mylar. The top and bottom laminates 20 and 21 have flat, upwardly and downwardly disposed exterior surfaces 22 and 23 and have flat downwardly and disposed, opposing, inner surfaces 24 and 25.

The top surface 25 of the bottom laminate 21 carries and supports an elongate electric resistance heater element E which is arranged in a zig-zag or serpentine pattern throughout the major area of the surface 25, inward from the marginal or perimeter portion of the laminates. The element E can be a simple resistance wire hand-laid or otherwise positioned atop the laminate 21 but is preferably a flat, ribbon-like foil element of aluminum established by first fixing a foil sheet of aluminum to the surface 25, suitably masking the upper or exposed surface of the foil sheet and then removing the unmasked portion of the foil sheet by a suitable chemical etching process, to leave the desired element. The element E is provided with suitable inlet and outlet terminals at opposite ends thereof (not shown).

The top laminate 20 is positioned atop the laminate 21 and the element E and is sealingly fixed and bonded thereto by a suitable sealing and bonding agent or material. The heater unit H next includes a downwardly opening shell-like terminal cap 25 which is sealingly fixed to the top surface 22 of the top laminate 20 above the power terminals and overlying terminal access openings (not shown) provided in the top laminate. The cap 25 has an opening at one side thereof to accommodate the inner end portion of a suitable elongate flexible power service cord P. The cord P has a pair of insulated conductors, as clearly shown in FIG. 5 of the drawings. The inner ends of the two conductors of the cord P are suitably connected with the power terminals of the element E. The terminal cap 26 is preferably filled with a suitably dielectric heat resistant potting material, as indicated at 27.

The form of the above noted power terminals and the manner and means by which the conductors of the cord P are connected therewith can be varied greatly without in any way affecting our invention and since many well-known and different structures and means are employed throughout the art to connect such conductors with such terminals, detailed illustration and further description of any one particular structure or means will be dispensed with.

In accordance with the foregoing and with common practice, the heater unit H includes a manually adjustable temperature control unit U engaged in the cord P, between the ends thereof. The cord and has a power service plug 28 at its outer free end. The plug 28 is shown engaged in a power service wall outlet. The unit U, in accordance with common practice, includes an adjustable thermostatic switch (or equivalent switching means) connected in one of the conductors of the cord D and is shown provided with a temperature sensing device 29 (such as a thermoster) at the free end of an elongate, flexible conductor 30. The device 29 is positioned between the mattress M and the frame F at a location spaced remote from the heater H where it is effective to sense the mean temperature of the water in the mattress and where it is not directly responsive to or affected by changes in temperature of the water at or in close proximity to the heater H.

The structure thus far described is essentially the same and does not depart from most common and/or ordinary waterbed structures with related resistance type heater units in any material manner.

It is to be noted that when the mattress M, described above, is filled with water to, for example, 8 inches, there exists a large volume of water which serves as a heat sink that absorbs and disperses heat generated by the heater H at a sufficiently rapid rate so that the heat generated by the heater does not accumulate at and about the heater, but rather, is absorbed and dispersed by the water so that the heater structure and the portion of the bottom wall 15 of the mattress M adjacent thereto are maintained at low and safe operating temperatures. That is, at low temperatures which are well below those temperatures at which degradation of the plastic materials might commence or at which other heat damage is likely to be caused.

It is also to be noted that if the depth of the water in the mattress drops to, for example, 4 inches, the heat sink capacity of the remaining water, that is, the capacity of the water to absorb and disperse heat generated by the heater unit H, is reduced by one-half and that the possibility of and/or likelihood that heat generated by the heater unit H will commence to accumulate and result in overheating the heater unit and the adjacent portion of the mattress exists. Further, there exists the possibility and/or likelihood that a person atop the mattress will cause the top wall of the mattress to "bottom out" or establish direct heat conducting contact with the portion of the bottom wall of the mattress above the heater unit, in which case heat generated by the heater unit is conducted directly through the adjacent walls of the mattress to the body of the person and overheating and various apparent serious adverse effects are likely to occur.

In furtherance of our invention, to prevent those adverse effects which might occur when the depth of the water in the mattress M lowers to a predetermined extent, we provide a novel, fluid pressure actuated safety switch S to start and stop the flow of electric current through the heater unit H and which is positioned beneath the mattress M is pressure conducting relationship therewith. The switch S is a normally open switch which is actuated and closed by downwardly directed vertically applied pressures or forces which are equal to and greater than the hydrostatic head pressure of the water in the mattress M when the depth of the water in the mattress is less than the safe minimum operating depth of water.

In practice, it is sufficient that the actuating force for the switch is between 0.149 psi and 0.224 psi (which is the same as the hydrostatic head pressure of the water in the mattress when the depth of the water therein is from 4.0 inches to 6 inches).

One preferred form of our safety switch S is shown in FIGS. 6 through 10 of the drawings. The switch S is incorporated in the heater unit H as an integral part thereof and is connected in and operatively related to the element E. The element E is broken or interrupted at a suitable and desired location between its ends to establish a switch opening O and a pair of spaced switch pads or terminals T. The pads of terminals T are defined by the flat, ribbon-like end portions of the element E occurring at the opposite sides of and defining the opening O. The terminals T have flat, upwardly disposed top surfaces.

The safety switch S next includes a metal contact bar B normally spaced above and overlying the switching opening O and terminals T and an insulating support part I between the bottom laminate 21 and the bar, supporting the bar B in spaced relationship above the terminals T.

The contact bar B is positioned within the heater H below the top laminate 20 in force transmitting relationship therewith whereby the force or weight of the mattress M above the laminate 20 is exerted onto and normally tends to urge and move the bar B downwardly towards and into engagement with the terminals T and to close the switch S.

In the preferred carrying out of our invention, the insulating part I is established of heat resistant silicone rubber (synthetic rubber) of predetermined shore hardness or durometer and of predetermined thickness so that the part I will yield and compress sufficiently to allow or permit the bar B to contact the terminals T under the force exerted upon it by the bar B when the bar is acted upon and urged downwardly by the weight of the mattress when the depth of the water in the mattress is at a safe operating depth. In the example given, the part I yields sufficiently to allow the bar B to contact the terminals T when the depth of water is between 6 inches and no less than 4 inches and the hydrostatic head pressure in the mattress above the bar is between 0.149 psi and 0.224 psi.

In practice, the ordinary blanket-type waterbed heater unit is quite thin and flexible and tends to bend, flex and yield to the top surface of the deck 10 of its related waterbed frame. If the top surface of the deck is uneven beneath the heater unit, it is possible that the two spaced switch pads or terminals T of the switch S will be set at different angles and/or on different planes. Also, it is not infrequent that the portion of the bottom wall 15 of the mattress engaged with and overlying heater unit will be set with a fold or wrinkle which might result in the uneven distribution and/or application of force onto and throughout the horizontal plane of the switch S and cause angular dispositioning of the bar B. If either or both of the foregoing conditions occur, there is a likelihood that the safety switch will not fully close or function properly.

In accordance with the above, in the form of our invention now under consideration, the terminals T are elongated to a substantial extent and the bar B is an elongate strap or ribbon of flexible metal sufficiently long to extend over the switch opening O and substantially coextensive with the elongate terminals T. Additionally, each end portion of the bar B is formed with a plurality of longitudinally spaced, downwardly projecting contact posts P with flat, downwardly disposed contact surfaces 50 which normally occur in spaced relationship above and are movable downwardly into contact with the top surface of their related terminals T. With such a contact bar structure, it will be apparent that the number of points of contact, the spacing of those points of contact, and the flexibility of the bar cooperate and are such that making and breaking of contact between each terminal T and at least one of the posts P related to it is substantially assured even if the terminals T and/or bar B are displaced from their intended normal position in the heater structure.

In the case illustrated, the posts P are shown as elements or parts formed in the bar by a suitable drawing or forming operation.

Further, the insulating support part I is established of a strip of rubber dye-cut to fully underlie and provide stable support for the bar B and has openings 51 cut therein to accommodate the posts, as clearly shown in the drawings.

In the switch structure set forth above, the vertical dimension or thickness of the part I is sufficiently great so that its capacity to yield and compress to a desired extent under predetermined narrow ranges of operating forces, can be quite easily established. That is, the above noted and illustrated structure provides for a sufficient amount (thickness and volume) of resilient compressible rubber compound (of which the part I is established) to work upon or with to easily adjust and impart the part I with necessary and desired functional characteristics.

The openings 51 are made sufficiently large in cross-section to allow for necessary horizontal or cross-sectional expansion of the portions of the part I which define the openings, when the part I is compressed (see FIG. 10 of the drawings), and also serve to orient and prevent horizontal displacement of the bar B relative to the part I.

Figure 3:
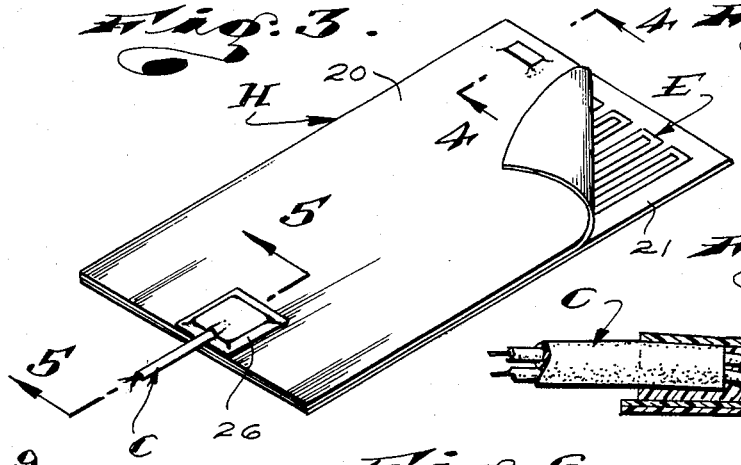
FIG. 3 is an isometric view of a heater unit embodying our invention.
Figure 4:
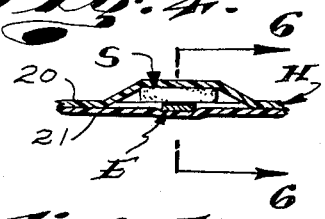
FIG. 4 is an enlarged sectional view taken substantially as indicated by line 4—4 on FIG. 3.
Figure 5:
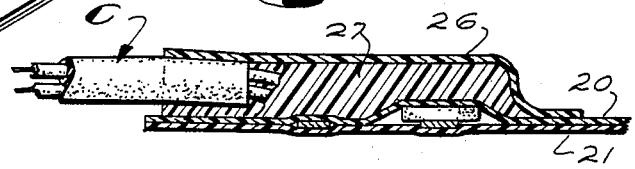
FIG. 5 is an enlarged sectional view taken as indicated by line 5—5 of FIG. 3.
Figure 6:
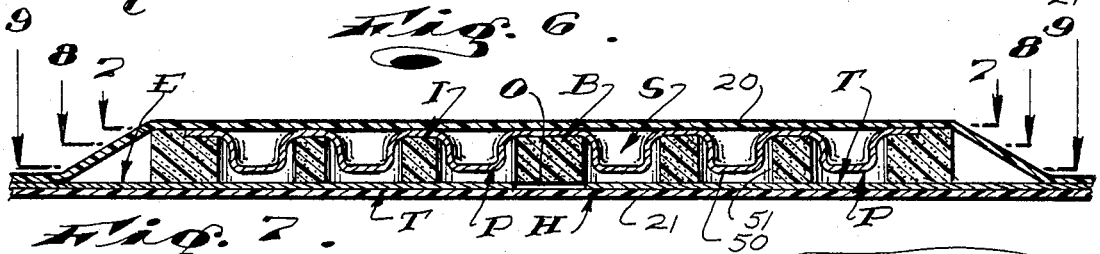
FIG. 6 is a view taken substantially as indicated by line 6—6 on FIG. 4.
Figure 7:
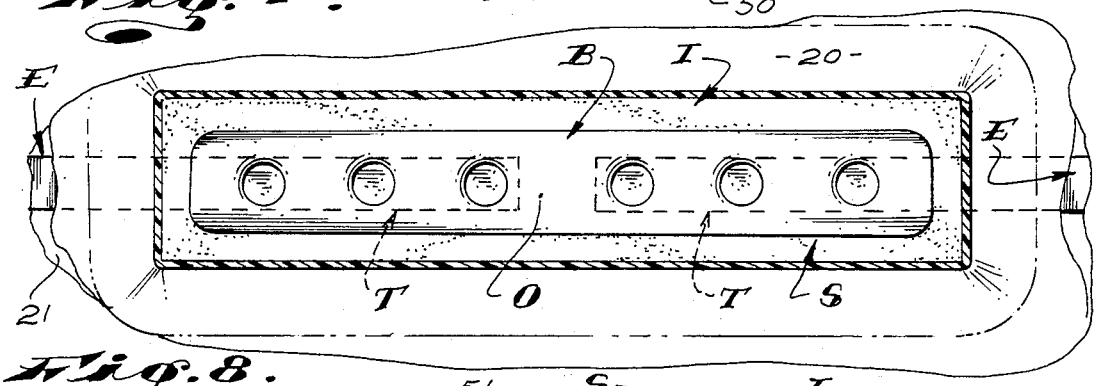
FIGS. 7, 8 and 9 are sectional views taken substantially as indicated by lines 7—7, 8—8 and 9—9 on FIG. 6 of the drawings.
Figure 8:
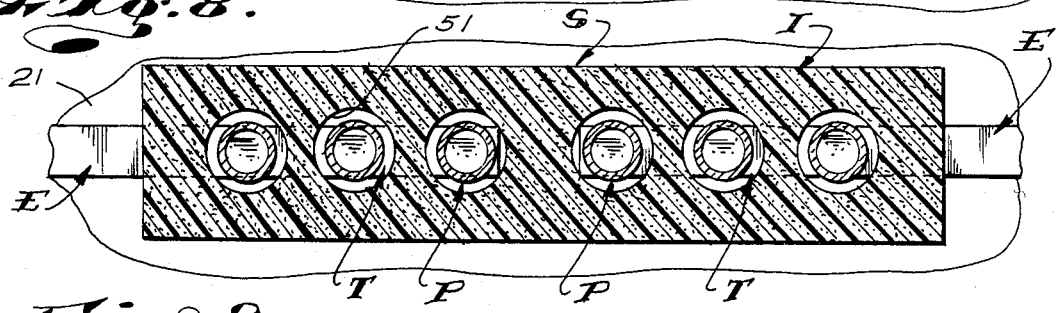
Figure 9:
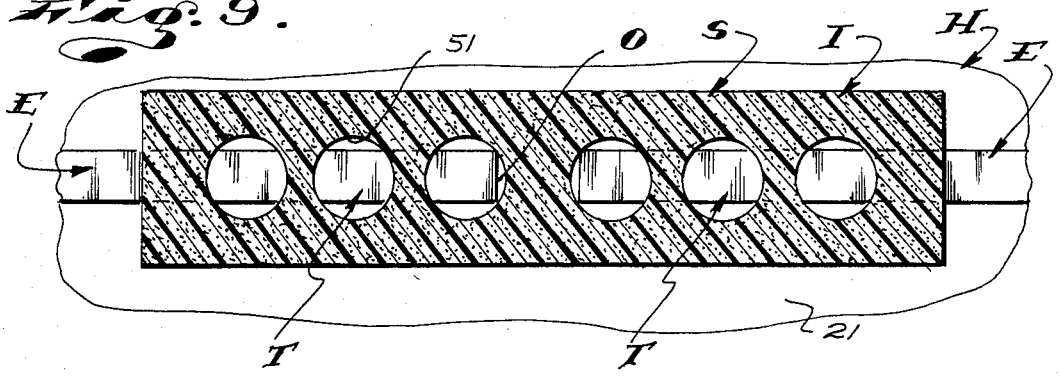
Figure 10:
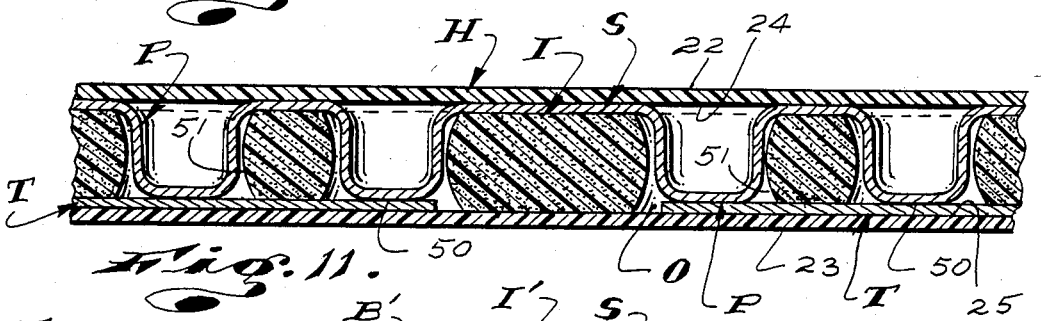
FIG. 10 is an enlarged detailed sectional view of a portion of the structure shown on FIG. 6 with parts in another position.

In practice and as shown in FIG. 3 of the drawings at section line 5—5 and in FIG. 5 of the drawings, the switch S can be positioned beneath the terminal cap 26. Alternatively, and as shown at section line 4—4 in FIG. 3 and in FIGS. 4 and 6 through 10 of the drawings, the switch S can and is preferably located within the plane area of the heater remote from the cap 26. In either case, the switch S is enveloped within the heater unit beneath the top laminate 20 and in such a manner that the laminate 20 serves to hold it in position above and relative to the spaced terminals T established by the switch opening O in the element E. The foregoing noted retention of the switch parts by the top laminate 20 is assured when the top laminate is bonded to the bottom laminate 21 of the heater during fabrication of the heater.

Figure 11:
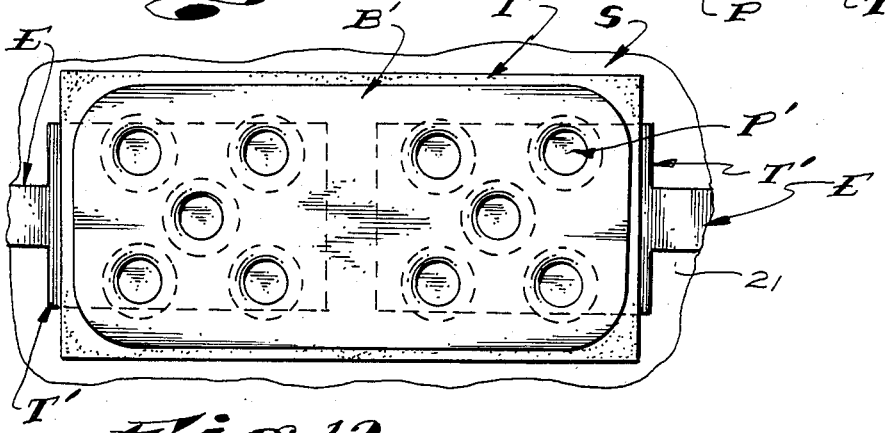
FIG. 11 is a plan view showing parts of our switch in modified form.

In FIG. 11 of the drawings, we have shown a modified form of our safety switch S′ wherein the terminals T′ are made shorter and wider than the terminals T in the first form of the invention; the insulating support part I′ and the bar B′ are made correspondingly shorter and wider; and the number of posts P′ is increased and the pattern of those posts is altered to best utilize the plane areas of the switch parts.

This form of our invention does not constitute a material departure from the previously illustrated and described form of the invention, but simply illustrates one manner in which the switch might be modified.

Figure 12:
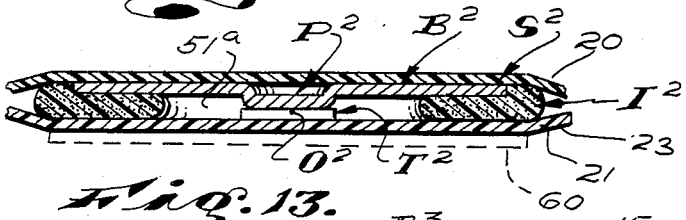
FIG. 12 is a sectional view of another form of our invention.

In FIG. 12 of the drawings, we have illustrated another form of our switch $S^2$ (in actuated or closed position) wherein the contact bar $B^2$ has but one central contact post $P^2$ of limited vertical extent and the insualting support part $I^2$, with its post-receiving opening $51^A$ is of less thickness or vertical extent than the parts I and I′ in the two previously considered forms of the invention. The contact bar $B^2$ is a substantially rigid, substantially non-flexible part.

The switch structure $S^2$ now under consideration next includes a stiff, substantially non-yielding back-up plate 60 fixed to the bottom surface 23 of the bottom laminate 21 beneath the switch structure within the heater unit.

The plane configuration of the switch structures $S^2$ is preferably round or disc-shaped but can, if desired, be made rectilinear, ovoid or any other suitable shape, if desired or if circumferences require. The switch structure $S^2$ is such that adjusting the insulating part $I^2$ to compress and expand a necessary extent, within set ranges of vertically applied forces can be easily effected by varying the size of the opening $51^A$ and to thereby increase or decrease the opposing or contacting surface area between the parts $I^2$ and $B^2$, as required.

While we have shown the switch structure $S^2$ having a single contact post $P^2$ which bridges the switch opening $O^2$ and makes contact with both terminals $T^2$, it will be apparent that two spaced terminal posts (one related to each terminal $T^2$) could be provided without departing from the broader aspects and spirit of our invention.

Figure 13:
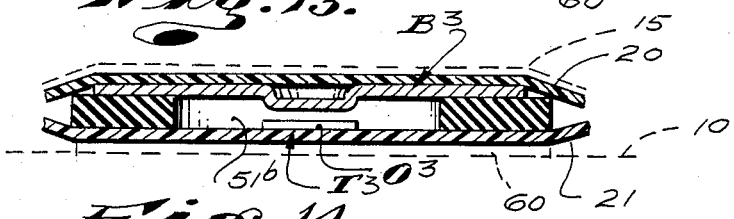
FIGS. 13 and 14 are sectional views of yet another form of our invention, in unactuated and actuated positions.
Figure 14:
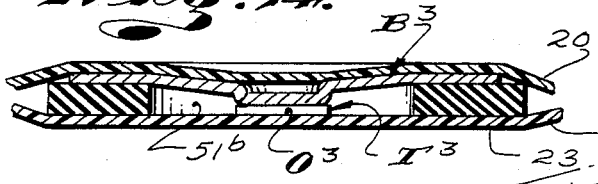

In FIGS. 13 and 14 of the drawings, we have shown another form of safety switch $S^3$ embodying our invention. The switch $S^3$ is characterized by an elongate, preferably rectilinear insulating support part $I^3$ with an elongate, slot-like vertical through opening $51^B$ and an elongate strap-like contact bar $B^3$. In this form of our invention, the part $I^3$ is a substantially rigid non-compressible part and the contact bar $B^3$ is a thin, flexible and resilient metal conductor.

For the purpose of this disclosure, the bar $B^3$, like the bar $B^2$, is shown formed with a single, central contact post $P^3$. The part $I^3$ and bar $B^3$ are related to each other and are positioned within the heater unit H between the top and bottom laminates 20 and 21 and relative to the switch opening $O^3$ and the terminals $T^3$ substantially as shown. The bar $B^3$ is arranged to extend longitudinally of the slot opening $51^B$ in the part $I^3$ with its opposite ends supported atop the part $I^3$. The bar $B^3$ is sufficiently stiff so that it is normally straight from end to the other and bridges the open top of the opening $51^B$ with its contact post $P^3$ in vertical spaced relationship above the terminals $T^3$.

A related portion of the thin, flexible, plastic top laminate 20 of the heater unit H overlies and is in uniform pressure transmitting engagement with the top surface of the bar $B^3$ and, in use, the laminate 20 is in uniform pressure transmitting engagement with the bottom wall 15 of the waterbed mattress with which the heater unit is related. Further, the bottom laminate 21 of the heater unit is in flat supported engagement atop the deck 10 of a related waterbed frame.

In addition to the above, if desired, a rigid or stiff reinforcing pad 60′ can be fixed to the bottom surface of the bottom laminate 21, beneath the switch $S^3$, to prevent or eliminate distortion of the switch structure and any attending adverse effects that might be caused by irregularities in the surface of the deck 10.

The contact bar $B^3$ is of predetermined or set resiliency and is such that when a minimum predetermined depth of water is contained by the mattress above the switch S, the hydrostatic head pressure of that water is transmitted downwardly onto the bar $B^3$ which is yieldingly biased and/or deflected downwardly to a closed position where the contact post or posts contact the terminals $T^3$, as clearly in FIG. 14 of the drawings.

Figure 15:
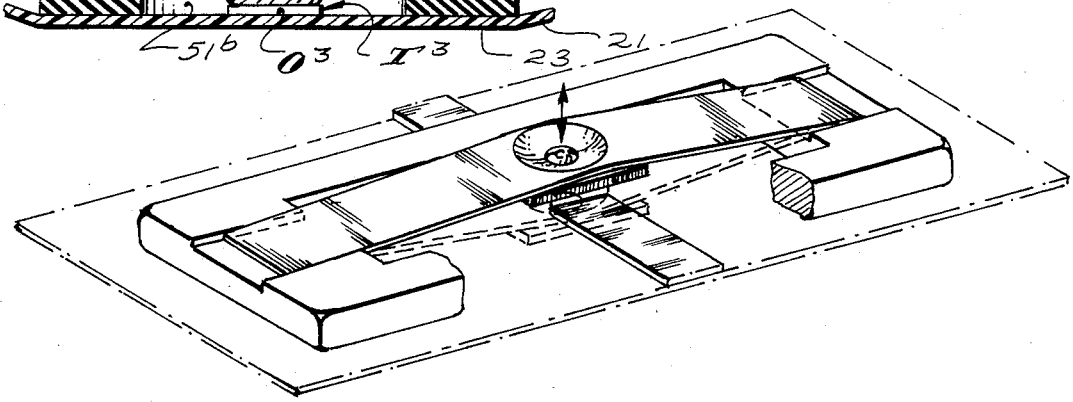
FIG. 15 is an isometric view of another form of safety switch contact bar that can be used in carrying out our invention.

Finally, in FIG. 15 of the drawings, we have illustrated another form of resilient contact bar $B^4$ which can be advantageously used in place of the bar $B^3$ that is shown in FIGS. 13 and 14 and described above.

The contact bar $B^4$ is an elongate, substantially horizontal ribbon-like spring metal part with an upwardly opening concavo, convex dimple formed at its center or intermediate its ends. The dimple normally yieldingly stiffens the adjacent central portion of the bar and prevents downward biasing and deflection thereof until a predetermined downwardly directed actuating force is exerted upon it. When said predetermined actuating force is exerted upon the central dimpled portion of the bar $B^4$, the bar pops and moves rapidly downwardly to an actuated position. The bar remains in said actuated position until the actuating force is released therefrom whereupon it pops back to its upper unactuated position. The popping action of the bar $B^4$ between its actuated and unactuated positions is that action which is commonly referred to as "oil canning".

While the special form of spring used to establish the bar $B^4$ is extremely old and well-known throughout the mechanical art, it has not been given any standard or common name. Accordingly, for the purpose of this disclosure, it can be appropriately defined and will hereinafter be called an "elongate twoposition poppet spring" or more briefly, a "poppet spring".

In addition to the above, the poppet spring is shown as being formed with a vertical aperture in the center of the central dimple and a flat terminal engaging contact plate 70 is secured to the bottom of the dimple, has limited semi-universal movement by means of a rivet 71 carried by the plate 70 and engaged through said aperture. The plate 70 can be of any desired size and shape and assures the establishing of proper contact with and between the pair of spaced switch terminals.

The contact bar $B^4$ can be made to actuate or pop between its actuated and unactuated positions within an extremely narrow range of forces and can be made to operate under rather light operating forces. Further, the bar $B^4$ can be made so that the vertical movement of the central portion thereof and of the contact plate 70 carried thereby, between its actuated and unactuated positions, is substantial and sufficiently great of assures complete and effective opening and closing of the switch of which the bar $B^4$ is a part. Finally, the "oil canning" or popping action of the bar $B^4$ is such that opening and closing of the switch structure of which the bar $B^4$ is a part is rapid and positive and such that there is little or no likelihood that contact bounce or chatter will be encountered during normal use and operation of the switch structure.

While we have shown the element E of the heater unit as a thin, flat, ribbon-like element, it will be apparent that any one of the several forms of safety switch illustrated and described above can be made to work in heater units wire heating elements. Any changes that might have to be made in the switch structure would be obvious and simple to make.

While we have shown and described our safety switch structures related to and/or incorporated in the blanket portion of a heater unit, it is contemplated that structurally equivalent and functionally identical safety switch structures might be related to the power cord of related heater units. In such a case, one of the conductors of the heater unit cord (an equivalent of the heater element) would be cut to establish the switch opening and terminals for the safety switch. Further, in such a case, the switch structure would be arranged between the top and bottom laminates of a separate envelope structure, which laminates would be the equivalent of the top and bottom laminates of the heater structures illustrated and described above.

Having described only typical preferred forms and embodiments of our invention, we do not wish to be limited to the specific details herein set forth, but wish to reserve to ourselves any modifications and/or variations that might appear to those skilled in the art and which fall within the scope of the following claims:

Having described our invention, we claim:

1. In combination, a waterbed structure comprising a frame with a horizontal deck with a flat, upwardly disposed mattress supporting surface and with upwardly projecting retaining walls about its perimeter, a mattress bladder of soft, flexible and pliable sheet plastic normally filled with a full volume of water and having a horizontal bottom wall in flat supported engagement with said supporting surface, vertical side walls in supported engagement with said retaining wall and a normally flat, horizontal body supporting top wall on a horizontal plane spaced above the bottom wall and substantially coplanar with a plane defined by upper edges of the retaining wall, the normal functional vertical spacing of the top and bottom walls and the depth of water in the mattress is in excess of 5 inches and has a hydrostatic head pressure in excess of 0.187 psi at said bottom wall, an electric resistance heater unit including an elongate electric resistance element between a bottom laminate of dielectric plastic material and a thin, flexible top laminate of dielectric plastic material, said heater unit is positioned between said deck and bottom wall with said bottom laminate in supported engagement with said supporting surface and said top laminate in uniform pressure transmitting engagement with said bottom wall, a normally open safety switch engaged in said element and operating to close and establish current flow through the element when said hydrostatic head pressure is at or in excess of 0.149 psi and to open and stop current flow through the element when said hydrostatic pressure is less than 0.149 psi, said switch includes a pair of spaced apart terminals atop the bottom laminate at related end sections of said element, an electric conducting contact bar extending between and engageable with said terminals is positioned in force transmitting relationship with and below said top laminate and above said terminals and an insulating support part between said bottom laminate and element and said top laminate and bar supporting the bar in spaced relationship above the terminals when said hydrostatic head pressure is less than 0.149 psi.

2. The combination set forth in claim 1 wherein said insulating support part is made of a resilient compressible dielectric material and is yieldingly compressed downwardly by the bar and the top laminate by the hydrostatic head pressure transmitted by said bottom wall onto said top laminate.

3. The combination set forth in claim 2 wherein said bar extends between, overlies and has outer portions extending outwardly from opposite ends of a switch opening defined by and between the terminals and outward from said terminals, said insulating support part engages and supports said outer portions of the bar.

4. The combination set forth in claim 2 wherein said bar is a flexible part positioned adjacent a bottom surface of said top laminate and moves vertically with said top laminate upon vertical movement of said top laminate in response to changes in the hydrostatic head pressure applied to it.

5. The combination set forth in claim 1 wherein said bar extends between, overlies and has outer portions extending outwardly from opposite ends of a switch opening defined by and between the terminals and outward from said terminals.

6. The combination set forth in claim 5 wherein said terminals have flat top surfaces, said bar has a plurality of spaced apart depending contact posts with downwardly disposed contact surfaces above each terminal.

7. The combination set forth in claim 5 wherein said insulating support part is made of a flexible, resilient, compressible, dielectric material and is positioned between the bar and the terminals and has vertical through openings into which the contact posts freely project.

8. The combination set forth in claim 5 wherein the bar is flexible about and between said contact posts and substantally conforms to the opposing surfaces of the insulating support part and the top laminate.

9. The combination set forth in claim 1 wherein said bar is an elongate, flexible, resilient, flat spring supported at its opposite ends by said insulating support part and has a downwardly disposed terminal engaging contact at its central portion between its ends, said central portion of the bar is yieldingly shiftable downwardly from a normal open position spaced above the terminal to an actuated closed position in contact with the terminal upon downwardly displacement of the top laminate above it under a predetermined actuating force corresponding with a minimum hydrostatic head pressure within said mattress.

10. The combination set forth in claim 9 wherein the flat spring of said bar is a popet spring with a formed central portion which pops to said closed position when forces equal to or greater than said actuating force is exerted upon it and pops to said open position when a force less than said actuating force is exerted upon it.

11. The combination set forth in claim 10 wherein said terminal engaging contact is a contact plate fixed to and carried by said central portion of said flat spring below said spring and above said terminal.

* * * * *